United States Patent [19]

Svyatsky et al.

[11] Patent Number: 4,607,833

[45] Date of Patent: Aug. 26, 1986

[54] DEMAND DOCUMENT FEEDER

[75] Inventors: Eduard Svyatsky, Chicago; K. George Rabindran, Morton Grove; Thomas J. Faber, Skokie, all of Ill.

[73] Assignee: Bell & Howell Company, Chicago, Ill.

[21] Appl. No.: 650,926

[22] Filed: Sep. 14, 1984

[51] Int. Cl.[4] ..... B65H 5/06; B65H 7/14

[52] U.S. Cl. ..... 271/10; 271/109; 271/258; 271/265; 209/900

[58] Field of Search ..... 271/10, 9, 21, 35, 109, 271/110, 113, 114, 116, 117, 112, 121, 124, 125, 126, 30.1, 31.1, 129, 258, 265, 197; 209/900

[56] References Cited

U.S. PATENT DOCUMENTS

| | | | |
|---|---|---|---|
| 2,759,729 | 8/1956 | Hedlun | 271/10 |
| 3,044,770 | 7/1962 | Breuers | 271/36 |
| 3,698,706 | 10/1972 | Mihojevich et al. | 271/197 X |
| 3,721,601 | 3/1973 | Pituch et al. | 271/9 X |
| 3,754,754 | 8/1973 | Peterson | 271/36 |
| 3,885,782 | 5/1975 | Wright et al. | 271/10 |
| 3,961,786 | 6/1976 | Yanker | 271/122 |
| 4,039,180 | 8/1977 | Stocker | 271/10 |
| 4,067,566 | 1/1978 | Williams | 271/35 X |

FOREIGN PATENT DOCUMENTS

| | | | |
|---|---|---|---|
| 1172885 | 6/1964 | Fed. Rep. of Germany | 209/900 |

OTHER PUBLICATIONS

*IBM Technical Disclosure Bulletin,* vol. 15, No. 7, pp. 2229,2230, Dec. 1972, "Sheet Feed Apparatus" W. E. Mott.

*Primary Examiner*—Bruce H. Stoner, Jr.
*Assistant Examiner*—Lawrence J. Goffney, Jr.
*Attorney, Agent, or Firm*—Alan B. Samlan; Alan H. Haggard; Neal C. Johnson

[57] ABSTRACT

A device for feeding envelopes from a hopper to an envelope reading station upon demand. A pair of drive rollers are mounted on a first drive shaft by means of a one-way clutch which allows the rollers to rotate only in a feeding direction. Mounted below the drive rollers are a pair of driven rollers which have a brake applying a force to them counter to the feeding direction. The braking force minimizes the possibility of feeding two documents at the same time. A second substantially identical set of rollers are mounted downstream of the first set of rollers. Upon demand envelopes are fed through the feeder and retained in the nip of the second set of rollers with a portion of the envelope extending into an envelope reading area. An operator reads address indicia from the envelope and keys it into envelope processing apparatus. Upon demand, the envelope is dropped from the feeder onto document transport means and the next succeeding document is fed into the second set of rollers wherein it is stopped so that it can be read. The cycle is repeated by control of the operator.

24 Claims, 5 Drawing Figures

DEMAND DOCUMENT FEEDER

BACKGROUND AND SUMMARY OF THE INVENTION

This invention relates to document feeders and more particularly to an envelope feeder used to transport documents from an envelope tray or hopper to a document reading location. The document is then read by an operator and upon command is released from the feeder and transported to envelope receiving bins.

There are many examples of times and places where envelopes are transported from a stack to an envelope reading station or to envelope processing equipment. Heretofore, the envelopes have often been withdrawn from the stack by a document feeder, deposited onto a transport mechanism, and transported to the document reading station. The document transport stops the document at the reading station where it is read by an operator and the operator performs a function in response to reading the envelope. For example, the envelopes can be pre-addressed and are transported to a reading station where the operator reads the zip code and keys it into a computer by means of a keyboard. The operator then advances the envelope to a bar-code printing station wherein a bar-code is printed on the envelope which corresponds to the zip code entered by the operator. It is apparent that there is a need to simplify the transporting of the envelopes from the hopper to the printer.

Applicant's invention provides a document feeder which employs a pair of drive rollers mounted on a first drive shaft. These rollers are rotated in a forwardly driving direction and mounted to the drive shaft by means of a one-way clutch which allows the drive rollers to rotate only in the forwardly driving direction.

Mounted below the drive rollers are a pair of driven rollers. The driven rollers rotate in an envelope feeding direction when an envelope is in the nip defined between the drive and driven rollers. The force of the driving roller is transmitted through the document to the driven roller causing the driven roller to rotate in the document feed direction. A relatively constant braking force is applied by braking means to the driven rollers to provide a relatively constant force counter to the force transmitted through the envelope. The braking force minimizes the possibility of two documents being fed through the nip at the same time by stopping the second envelope until the first envelope clears the nip. A second set of drive and driven rollers are positioned downstream of the first set to give added security of feeding only one envelope at a time and to hold the envelope with a portion of it extending into the reading area.

The drive rollers are connected to and driven by a reversible motor. Positioned between the two sets of rollers is a photo-electric sensor which signals a controller when the trailing edge of a document enters the second set or downstream set of rollers. The sensor gives a signal to the controller which stops and reverses the motor. The envelope does not move any substantial amount in the downstream direction after the trailing edge of the envelope passes the photo-electric sensor. The one-way clutches permit the shafts upon which the drive rollers are mounted to rotate in a direction counter to the feeding direction without causing the drive rollers to also rotate in the reverse feed direction. The brake means on the driven rollers stop the envelope against the drive roller with the trailing edge of the envelope retained in the nip. In this postion the address or zip code on the envelope can be read by an operator. Responsive to the operator's signal, the drive system is energized to release the envelope and transport the next following envelope through the rollers wherein the cycle is repeated. The envelopes are dropped from the second set of rollers onto an envelope transport and can be further processed.

Accordingly, an object of the invention is to provide an envelope feeding device that simply and efficiently transports envelopes from a hopper to a document reading area where the envelope is read, and upon command of the operator transported to further envelope processing means. Related to this is the object of feeding envelopes to the reading area and precisely stopping each envelope at a predetermined point.

Another object of the invention is to provide an envelope feeder which automatically compensates for various thicknesses and sizes of envelopes.

Still another object of the invention is to provide an envelope feeder which has means to separate envelopes and avoid two envelopes being simultaneously fed.

Many other objects and purposes of the invention will be clear from the following description of the drawings.

DETAILED DESCRIPTION OF THE PREFERRED EMBODIMENT

Reference is now made to the drawings which illustrate one embodiment of the unique envelope feeder of this invention. Although reference is made to an envelope feeder, the invention is equally applicable and operates upon individual sheets or documents.

Figure 1:
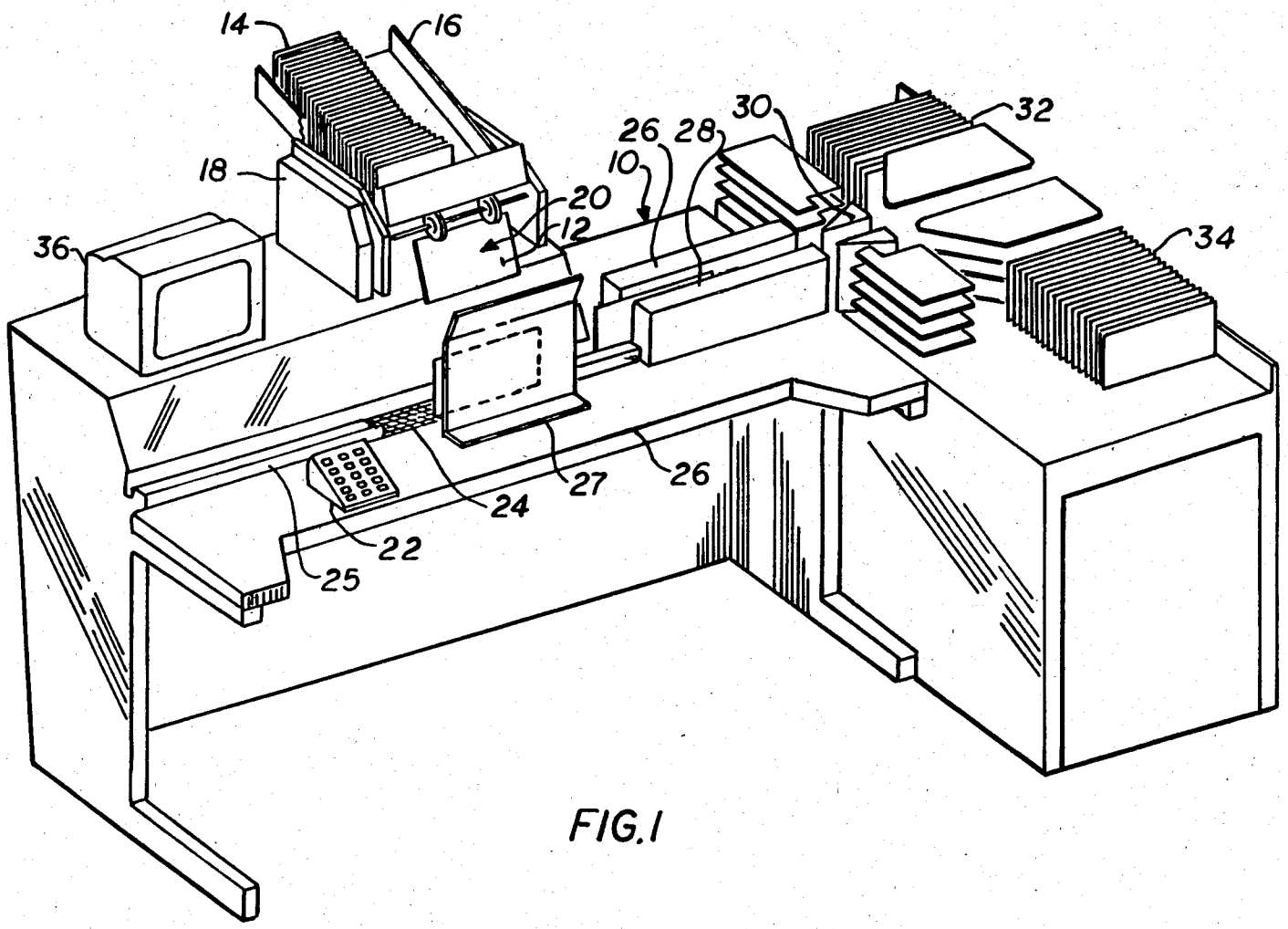
FIG. 1 is a perspective view of an envelope processing device in which the operator reads zip codes and a printing device prints a bar code on the envelope corresponding to the zip code.

Turning first to FIG. 1, there is a mail processing device 10 designed to print indicia, e.g., bar codes on an envelope responsive to an operator entering appropriate address information. Envelopes 12 are placed in a stack 14 on an envelope tray 16 which is part of an envelope feeder 18. The envelopes 12 are fed by the feeder 18 to a reading station 20 and then held by feeder 18 at the station 20. The feeder 18 is in front of an operator. The operator reads address information, e.g., the zip code on the envelope and keys that information into the mail processing device 10 by means of a keyboard 22. Upon command of the operator, the envelope feeder 18 drops the envelope 12 onto a transport belt 24 within a track 25 which is on the top table 26 of the device 10. An upright guide plate 27 keeps the envelopes in a vertical position and also keeps envelopes from falling off the belt 24 and track 25. The transport belt 24 is continuously moving and transports the envelope to a printing station 26 where a print module 28 prints the bar code on the envelope which corresponds to the zip code entered at the keyboard 22. Diverter gates 30 direct the envelope into either receiving tray 32 or 34 depending upon predetermined criteria. For example, one of the trays may receive envelopes with properly printed bar codes on it and the other tray may receive misprinted or rejected envelopes. A monitor 36 informs the operator of the zip code entered, preset key functions, or other information relevant to the operation of the device 10.

Figure 2:
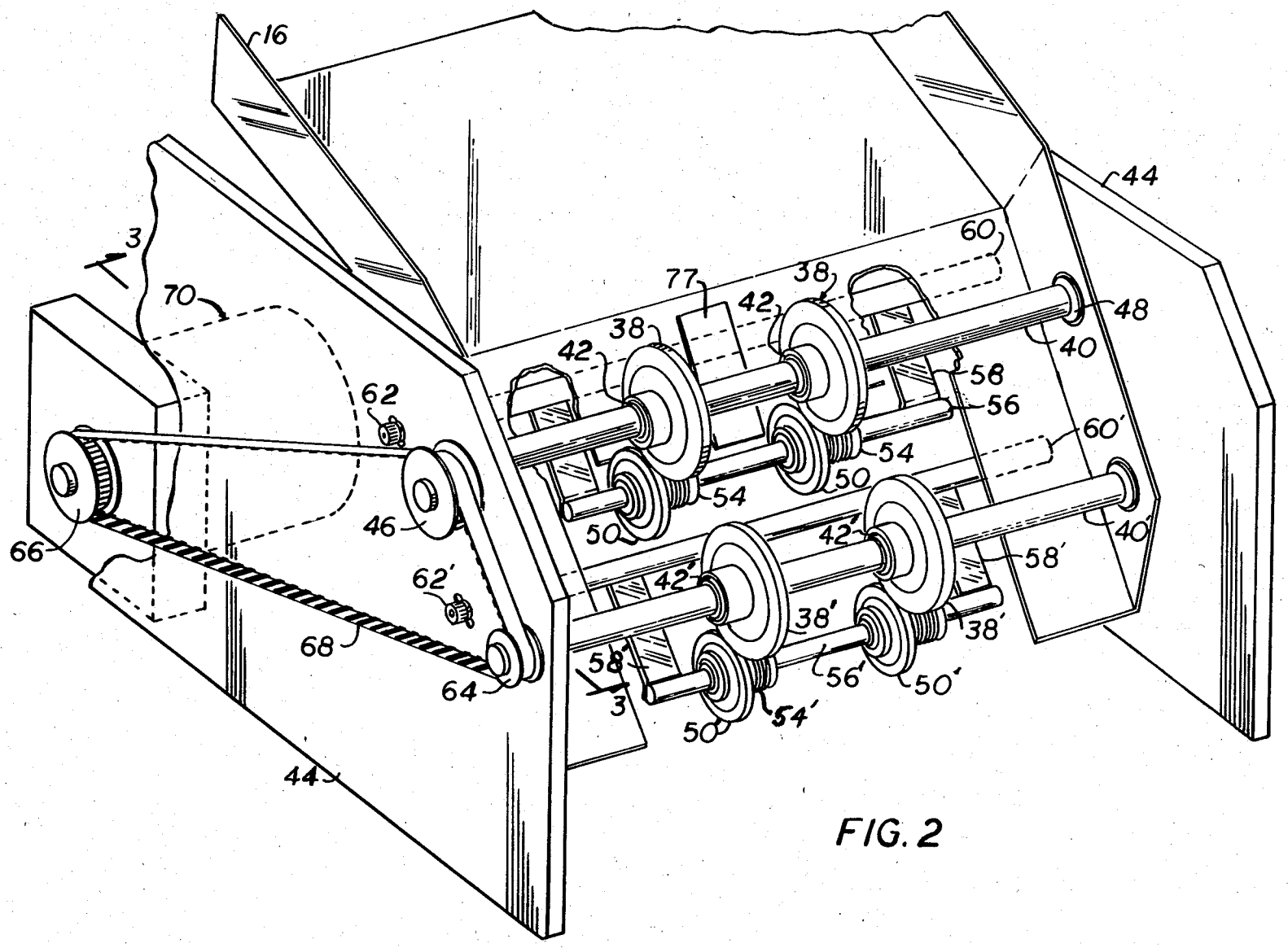
FIG. 2 is a perspective view of the inventive envelope feeder with portions removed for clarity.
Figure 3:
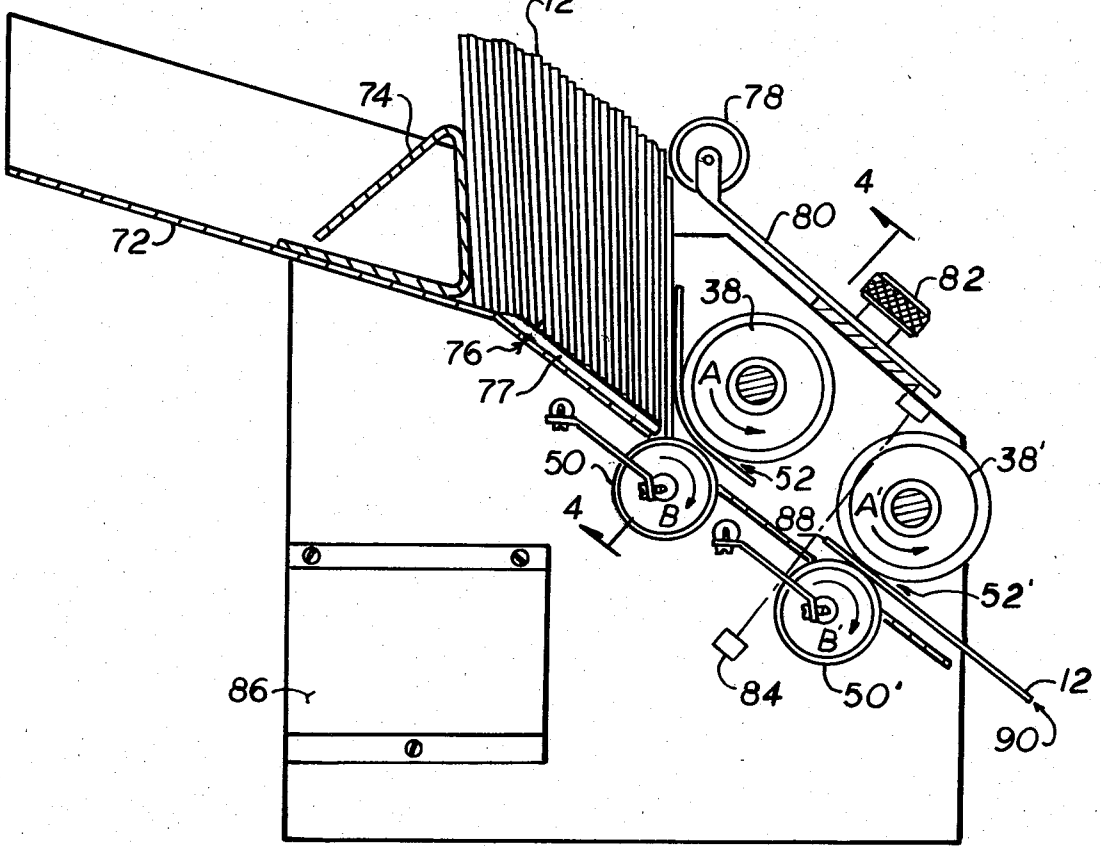
FIG. 3 is a cross-sectional view taken along line 3—3 of FIG. 2 with portions removed for clarity.
Figure 4:
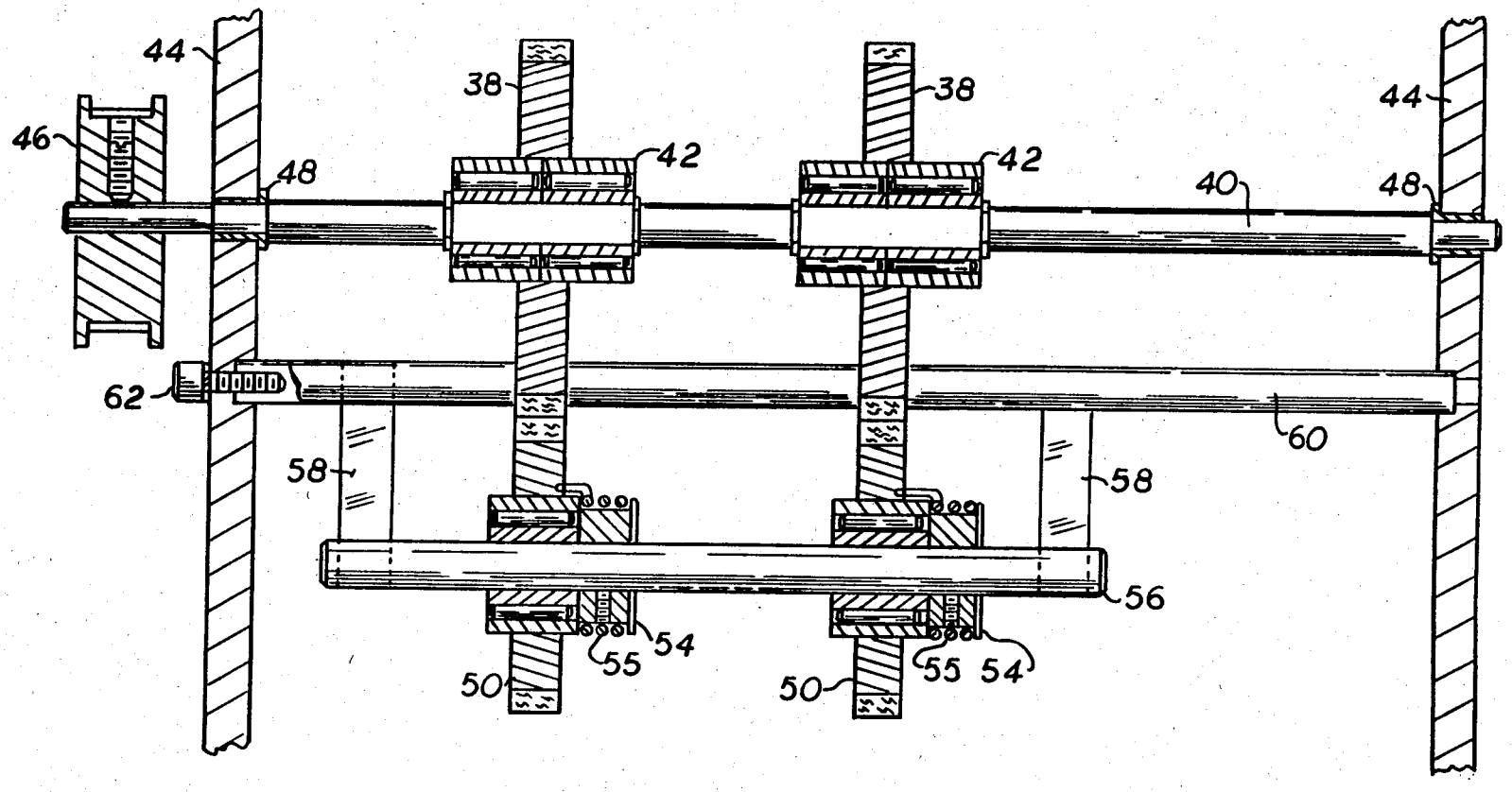
FIG. 4 is a cross-sectional view taken along line 4—4 of FIG. 3 with portions removed for clarity.
Figure 5:
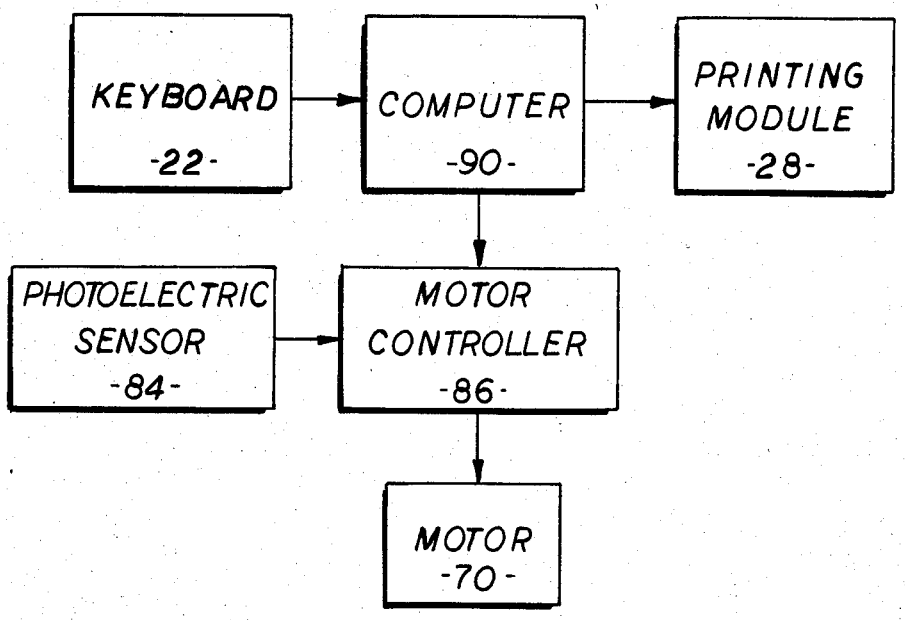
FIG. 5 is a block diagram flow chart of the input, logic and outputs of the electrical system of the envelope processing device.

The envelope feeder 18 is more clearly illustrated in FIGS. 2 through 4. The power drive mechanism is most clearly seen in FIG. 2. A pair of drive rollers 38 are mounted on a first drive shaft 40, each by by means of a one-way clutch 42. Such one-way clutches are of standard design and widely used. The first drive shaft 40 passes through frame 44 and has a first driven pulley 46 securely mounted to one end of it. Bearings 48 are mounted in the frame 44 to allow free rotation of the shaft 40. Collar assemblies (not shown) can be mounted on the first drive shaft 40 to assist in keeping the shaft 40 from inadvertent lateral movement along its long axis.

Mounted below the drive rollers 38 on a non rotating shaft 56 are a pair of driven rollers 50. Spring members 58 are securely fastened to the ends of shaft 56. The spring members 58 provide an upward force to maintain the circumferences of the rollers 38 and 50 in light contact with each other when no envelopes are between them. The rollers 38 and 50 define a nip 52 (see FIG. 3) through which the envelopes 12 pass. A pair of brake mechanisms 54 are also mounted on the non rotating shaft 56 adjacent each driven roller 50 (see FIG. 4). The brake mechanisms 54 have a spring 55 to provide a constant force to the driven rollers 50. The force of spring 55 is in a direction opposite to the envelope feed direction as will be described in detail later. The brake mechanisms are of standard operation and design as those skilled in the art will appreciate. The non rotating shaft 56 is connected to the frame 44 by means of spring members 58. These are in turn connected to an adjustable shaft 60 mounted to the frame 44. As can be seen in FIG. 4, an adjusting screw 62 passes through the frame 44 and into the adjustable shaft 60. By loosening the adjusting screw 62, the shaft 60 can be rotated and maintained in the desired position by retightening the screw 62. Thus, the amount of contact force between the driven rollers 50 and the drive rollers 38 can be adjusted.

An identical set of drive and driven rollers is located downstream (in the direction of envelope travel) of the first set of rollers previously described. The second set of rollers, springs and shafts, are identified by like prime numbers for simplicity and uniformity in understanding the invention. The difference in the two sets of rollers is that the second drive shaft 40′ has a second driven pulley 64 mounted on its end. The second driven pulley 64 has a smaller diameter than the first driven pulley 46. Encircling the first driven pulley 46, second driven pulley 64 and drive pulley 66 is a toothed belt 68. The drive pulley 66 is connected to a reversible A.C. motor 70 which when energized causes the drive pulley 66 to drive the belt 68 which in turn drives the pulleys 46 and 64. As the driven pulley 64 has a smaller diameter than the driven pulley 46, the second drive shaft 40′ will rotate faster than the first drive shaft 40. Thus the drive rollers 38′ will rotate faster than the drive rollers 38.

The description of the automatic feeding operation of the feeder can best be described by turning to FIG. 3. The envelopes 12 are stacked vertically with their bottom edges on a top portion 72 of the envelope tray 16. This takes the weight of the stack of envelopes away from the rollers 38 and 50. A large stack of documents in the envelope tray 16 would cause large forces on the rollers 38 and 50. There would also be excessive forces between envelopes which would make separation difficult and tend to cause more than one envelope to be fed at a time. A sliding weight 74 slides along the top portion 72 as the envelopes 12 are fed. This keeps the envelopes upright and moving into the feeder. The envelope tray 16 has a bottom portion 76 which is at a steeper angle than the top portion 72. A flat plate 77 with an antifriction surface aids in guiding the envelopes 12 and provides a smooth, non-sticking surface on which the envelopes 12 can easily slide from the tray 76 into the nip 52. To aid in feeding the envelopes 12 into the nip 52, a piece of spring steel (not illustrated) is placed under the plate 77. A moveable pin (not illustrated) below the spring steel can adjust the force and angle which the plate 77 applies to the envelopes 12. This directs and pushes the envelopes 12 into the nip 52. A roller 78 mounted on an upright support 80 helps in keeping larger envelopes 12 upright without having the envelopes falling forward. The height of the roller 78 can be adjusted by adjusting means 82 which permit movement of the support 80.

In operation, when the feeder is initially turned on, the motor 70 is energized causing the drive pulley 66 to drive the drive shafts 40, 40′ in an envelope feeding direction. The envelope 12 at the front of the stack 14 enters the nip 52. The envelope bends to pass between the rollers 38 and 50. This bending aids in separating the envelope being fed from the next adjacent envelope in the stack 14. The drive roller 38 rotates in the direction of arrow A (FIG. 3) and the driven roller 50 rotates in the direction of arrow B when a single document is in the nip 52. The circumferences of rollers 38 and 50 are made of soft rubber which results in high coefficients of friction between the rollers 38, 50 and the envelope 12. The force which drive roller 38 exerts on the envelope 12 is transmitted to the driven roller 50 due to the frictional forces of the rollers on the envelope. The force which the drive roller 38 transmits to the driven roller 50 is sufficient to overcome the force which the brake mechanism 54 continuously applies to roller 50 in a direction opposite the direction of arrow B.

The envelope 12 is fed from the first nip 52 to the nip 52′ which is between the second set of rollers. The document is handled by the second set of rollers in the same manner as it was transported through the first set of rollers. A photo-electric sensor 84 is positioned between the two sets of rollers (see FIG. 3). When an envelope 12 interrupts the sensing beam a first signal is sent to a motor controller 86 which initializes a control circuit. When a trailing edge 88 of the envelope 12 passes the sensing beam, the beam is reestablished and sends a second signal to the controller 86. When this second signal is received, the controller 86 causes the direction of motor 70 to be momentarily reversed and then stopped. This causes the drive pulley 66 and its associated drive train to momentarily reverse direction and the drive shafts 40 and 40′ to momentarily reverse direction. As the drive rollers 38, 38′ are connected to the drive shafts, 40, 40′ via one-way clutches, the drive rollers 38, 38′ will not rotate in the opposite direction but instead will immediately stop. The driven rollers, 50, 50′, in conjunction with their respective brakes, 54, 54', aid in stopping the drive rollers 38, 38' and hold them in the stopped position. Thus, the envelope 12 stops with its trailing edge 88 in the nip 52' and with its leading edge 90 extending into the reading station 20 where the operator can read the zip code from the front of the envelope 12. The reversal of the motor 70 in combination with the sensing and braking system causes each envelope 12 to stop in the same precise location. The inertia of the drive system and rollers does not effect the immediate stopping of the envelope 12. By adjusting the position of the sensor 84, the exact location where the envelopes stop can be adjusted.

If two confronting envelopes enter nip 52, the drive and driven roller configuration causes the top envelope to be fed while holding the bottom confronting envelope stationary. This occurs because the roller 38 continues rotating in the direction of arrow A and will continue driving the top envelope in the nip. However, the frictional force between the two confronting envelopes is not sufficient to cause the force of the drive roller 38 to transmit a sufficient force to the driven roller 50 to overcome the brake force. Thus the brake 54 keeps the driven roller 50 from rotating in the direction of arrow B. The coefficient of friction between the lower envelope and the surface of driven roller 50 is greater than the coefficient of friction between the two confronting envelopes causing the top envelope to slide over the bottom envelope and be fed downstream. As soon as the top envelope passes through the nip, the other envelope will be fed.

Due to the size of pulleys 46 and 64, feed roller 38' is rotating at a greater speed than roller 38. This creates a gap between the trailing edge 88 of the first envelope fed and the leading edge of the following envelope. This gap is necessary for sensing the trailing edge 88 so that the sensor 84 will stop the drive system as the trailing edge 88 of the first envelope enters the nip 52'. Without this gap between envelopes, the first envelope would pass through the second set of rollers and drop onto the transport belt 24 without the operator having a chance to read the zip code.

When the operator reads the address information on an envelope 22 and keys that data into keyboard 22, that data is transferred to a computer 90. As soon as computer 90 determines that all the necessary data has been keyed in by the operator, which can be by a predetermined number of data entries or by operator command, computer 90 sends a go control signal to motor controller 86 which will start motor 70 in the envelope feeding direction. In addition, computer 90 sends appropriate data to printing module 28 to allow the appropriate indicia or bar code information to be printed on the envelope 12 that the operator has just read.

Thus it is apparent that there has been provided, in accordance with the invention, an improved document feeder that fully satisfies the objects, aims and advantages set forth above. While the invention has been described in conjunction with a specific embodiment, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A document feeder for feeding envelopes from a hopper to a document reading station upon demand comprising:

a reversible motor;

a first driving shaft connected to and driven by the reversible motor;

a first driving roller;

a first one-way clutch connecting the first driving roller to the first driving shaft; the first one-way clutch enabling the first driving roller to be driven by the first driving shaft when the shaft is rotated in an envelope feeding direction, and enabling the first driving roller to disengage from the first driving shaft when the shaft is rotated in a direction opposite the envelope feeding direction;

a first driven roller mounted for rotation adjacent the first driving roller so that the circumferences of the rollers define a nip therebetween;

first brake means connected to the first driven roller for applying a brake force to the roller in a direction opposite the envelope feeding direction;

a second driving shaft connected to and driven by the reversible motor, the second driving shaft positioned downstream fo the first driving shaft;

a second driving roller;

a second one-way clutch connecting the second roller to the second driving shaft; the second one-way clutch enabling the second driving roller to be driven by the second drivng shaft when the shaft is rotated in the envelope feeding direction and enabling the second driving roller to disengage from the second driving shaft when the shaft is rotated in a direction opposite the envelope feeding direction;

a second driven roller mounted for rotation adjacent the second drivng roller and defining a second nip therebetween;

second brake means connected to the second driven roller for applying a brake force to the roller opposite the envelope feeding direction;

each driving roller in frictional engagment with the envelope during feeding and applying a feeding force to the envelope in the envelope feed direction, the feeding force transmitted by the first and second driving rollers to their corresponding first and second driven rollers being greater than the brake force applied by the first and second brake means to its corresponding first and second driven rollers, causing the friven roller to rotate in the envelope feed direction when a single envelope is in the nip, and when two or more confronting envelopes are within the nip, the brake force being greater than the feeding force transmitted to the driven roller so that the driven roller remains stationary while the driving roller continues feeding the envelope in contact with it while the driven roller restrains the envelope in contact with it causing one envelope in the nip to be fed at a time:

sensor means disposed between the first and second driving rollers to detect the trailing edge of the envelope as it is transported from the first driving roller to the second driving roller and for transmitting a signal when the trailing edge of the envelope is sensed;

controller menas for temporarily supplying a voltage to the motor to reverse its direction of rotation and for disconnecting the voltage from the motor thereby allwing the motor to stop;

each one-way clutch disengaging a corresponding driving roller from a corresponding driving shaft and the brake means stopping the rotation of the driving and driven rollers and the movement of the envelope in the second nip until a second envelope demand signal is received by the controller to start the motor in the envelope feeding direction.

2. The device of claim 1 and further comprising an envelope receiving transport means to receive the envelopes discharged from the second driving and driven rollers and to transport the discharged envelopes to further envelope processing apparatus.

3. The device of claim 1 and further comprising pairs of first and second driving and driven rollers.

4. The device of claim 1 and further comprising spring means for maintaining the driven rollers in contact with their respective driving rollers and automatically adjusting the nip for variations in envelope thickness.

5. The device of claim 1 and further comprising a first gear mounted on the first driving shaft, a second gear mounted on the second driving shaft, a drive belt encircling the first and second gears, the drive belt driven by the motor.

6. The device of claim 5 wherein the diameter of the second gear is smaller than the first gear causing the second driving shaft to rotate faster than the first driving shaft, whereby a gap is formed between the trailing edge of one envelope as it enters the second nip and the leading edge of the next following envelope as it remains in the first nip if the two envelopes are fed into the first nip at the same time.

7. The device of claim 1 wherein the envelopes are stacked in a vertical plane on their edges in the hopper, the front envelope in the stack being drawn into the nip by gravity and the first driven roller, the envelope being separated from the stack by being bent around the first driven roller to change its orientation from the vertical plane to a plane passing through the first and second nips.

8. The device of claim 1 wherein the hopper is placed above the feeder and the feeder is in line with the reading station so that the envelopes move in a plane perpendicular to the face of the envelopes from the hopper to the reading station.

9. The device of claim 1 wherein the trailing edge of each envelope is immediately and precisely stopped in the same location downstream of the sensor whereby an address portion of the envelope extending into the reading station is in substantially the same position for each envelope fed.

10. The device of claim 9 wherein the location of the sensor is adjustable to provide means to adjust the stopping location of the envelopes.

11. An envelope processing device for processing envelopes in an envelope feeding direction comprising:

an inclined tray for holding envelopes;

a reversible drive means for supplying rotational power;

first friction feed means including a first driving shaft, a first driving roller, a first one-way clutch connecting the first driving roller to the first driving shaft, a first driven roller mounted so that a portion of the circumference of the first driven roller and the first driving roller define a nip therebetween, and first brake means connected to the first driven roller for applying a braking force to the driven roller in a direction opposite the envelope feeding direction;

second friction feed means including a second driving shaft, a second driving roller, a second one-way clutch connecting the second driving roller to the second driving shaft, a second driven roller mounted so that a portion of the circumference of the second driven roller and the second driving roller define a nip therebetween, and second brake means connected to the second driven roller for applying a braking force to the driven roller in a direction opposite the envelope feeding direction;

means for mounting the second friction feed means downstream from the first friction feed means;

means for connecting the first and the second drive shafts to the reversible drive means;

sensing means for sensing the trailing edge of an envelope as it moves from the first friction feed means to the second friction feed means and for generating a stop control signal;

means for reversing and then stopping the reversible drive means when the sensor means detects the trailing edge of an envelope; and means for starting the reversible drive means in the forward envelope feeding direction when an operator has keyed in information from the envelope.

12. The device of claim 11 wherein the first and second one-way clutches allow the first and second driving shafts to rotate only in the envelope feeding direction, and the driving rollers are held in a stopped position by the driven rollers and brake means when the drive means reverses and supplies power in the direction opposite the envelope feeding direction.

13. The device of claim 11 wherein the reversible drive means comprises a reversible motor and drive and the means for reversing and then stopping the reversible drive comprises a motor controller which receives the stop control signal and causes a voltage to the motor to be momentarily reversed and then disconnected from the motor.

14. The device of claim 13 wherein the means for starting the reversible drive means comprises a go control signal from a computer, the go control signal sent responsive to the operator keyed in information.

15. The device of claim 12 wherein the trailing edge of the envelope is held in the nip defined by the second driving and driven rollers when the drive means is energized in the direction opposite the envelope feeding direction and then stopped.

16. The device of claim 11 wherein the trailing edge of each envelope is immediately and precisely stopped in the same location downstream of the sensor whereby the information portion of the envelope extends into an operator reading station in substantially the same position for each envelope fed.

17. The device of claim 16 wherein the location of the sensor is adjustable to provide means to adjust the stopping location of the envelopes.

18. An envelope processing device comprising:

an inclined tray for holding a stack of envelopes, the inclined tray for holding a stack of envelopes, the inclined tray supporting one edge opposite the supporting envelope having a trailing edge opposite the supporting edge;

first friction feed means having a pair of rollers defining a nip and serving as means for separating the leading envelope of the stack from the rest of the stack and for feeding the supported edge of the envelope into its nip;

second friction feed means having a pair of rollers defining a nip and serving as means for separating the leading envelope of any pair of confronting envelopes fed by the first friction feed means from the other of the pair and for feeding the supported edge of the envelope into its nip;

means for mounting the second friction feeder means downstream from the first friction feeder means;

reversible drive means operatively connected to the first and second friction feed means for supplying rotational power in a forward envelope feed direction and a reverse encelope stopping direction;

sensing means for sensing the trailing edge of an envelope as it moves from the first friction feed means to the second friction feed means and for generating a stop control signal;

motor control means operated responsive to receiving the stop control signal for reversing and then stopping the reversible drive means when the sensing means detects the trailing edge of the envelope;

means for starting the reversible drive means in a forward direction when an operator has inputted information read from the envelope.

19. The device of claim 18 wherein the reversible drive means comprises a reversible motor and drive connected to the first and second friction feed means with the second friction feed means being driven at a greater speed than the first friction feed means.

20. The device of claim 19 wherein the motor controller receives the stop control signed and causes a voltage to the motor to be momentarily reversed and their disconnected from the motor causing the motor to stop.

21. The device of claim 19 and further comprising a computer, the computer sending a go control signal to the motor controller to start the reversible drive in the forward envelope feed direction, the go control signal responsive to the operator inputting information to the computer.

22. The device of claim 19 wherein the trailing edge of the envelope is held in the nip of the second friction feed means when the drive means reverses direction, and is held therein until the drive means is energized in the envelope feeding direction.

23. The device of claim 18 wherein the trailing edge of each envelope is immediately and precisely stopped in the same location downstream of the sensor whereby the information portion of the envelope extending into the reading station is in substantially the same position for each envelope fed.

24. The devoce of claim 23 wherein the location of the sensor is adjustable to provide means to adjust the stopping location of the envelopes.

* * * * *